United States Patent [19]

Kunter et al.

[11] 3,952,336

[45] Apr. 27, 1976

[54] DISPOSABLE BEDPAN DEVICE

[75] Inventors: Sona V. Kunter; Margaret Harrison, both of New York, N.Y.

[73] Assignee: The Raymond Lee Organization, Inc., New York, N.Y. ; a part interest

[22] Filed: Feb. 25, 1975

[21] Appl. No.: 552,843

[52] U.S. Cl. ..... 4/112; 4/113; 4/142

[51] Int. Cl.[2] ..... A61G 9/00

[58] Field of Search ..... 4/110, 111, 112, 113, 4/138, 141, 142; 128/295

[56] References Cited

UNITED STATES PATENTS

| | | | |
|---|---|---|---|
| 2,337,648 | 12/1943 | Clarke | 4/113 |
| 2,734,198 | 2/1956 | Kutsche | 4/110 |
| 2,747,199 | 5/1956 | Flexman et al. | 4/112 |
| 2,875,451 | 3/1959 | Stegeman | 4/110 |
| 2,985,888 | 5/1961 | Whelan | 4/113 |
| 3,084,348 | 4/1963 | Parker et al. | 4/113 |
| 3,403,410 | 10/1968 | Benzel et al. | 4/110 |
| 3,432,863 | 3/1969 | Schwartz | 4/110 |
| 3,742,523 | 7/1973 | Atkins | 4/110 |

*Primary Examiner*—Henry K. Artis
*Attorney, Agent, or Firm*—Daniel Jay Tick

[57] ABSTRACT

A collar of soft foam material is provided around the open mouth of a waterproof soft-textured material bag. The foam material is adherent to the skin of a user to insure a snug fit when in use. A flexible wire is embedded in the collar and extends around the mouth for adjusting the opening of the mouth.

1 Claim, 3 Drawing Figures

FIG. 1
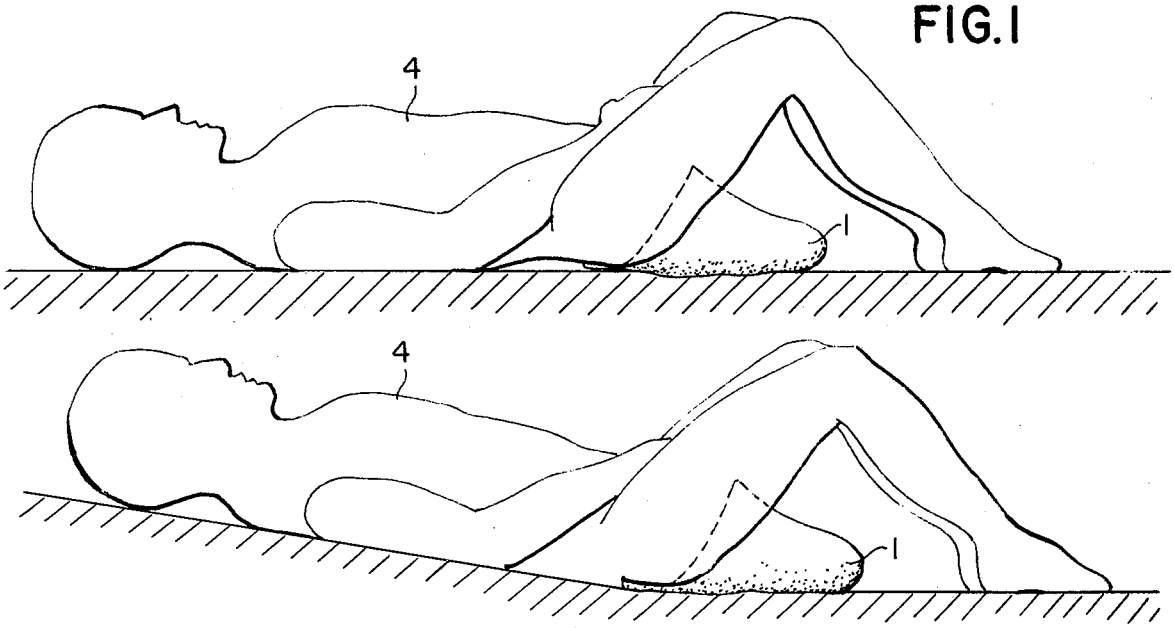
FIG. 2
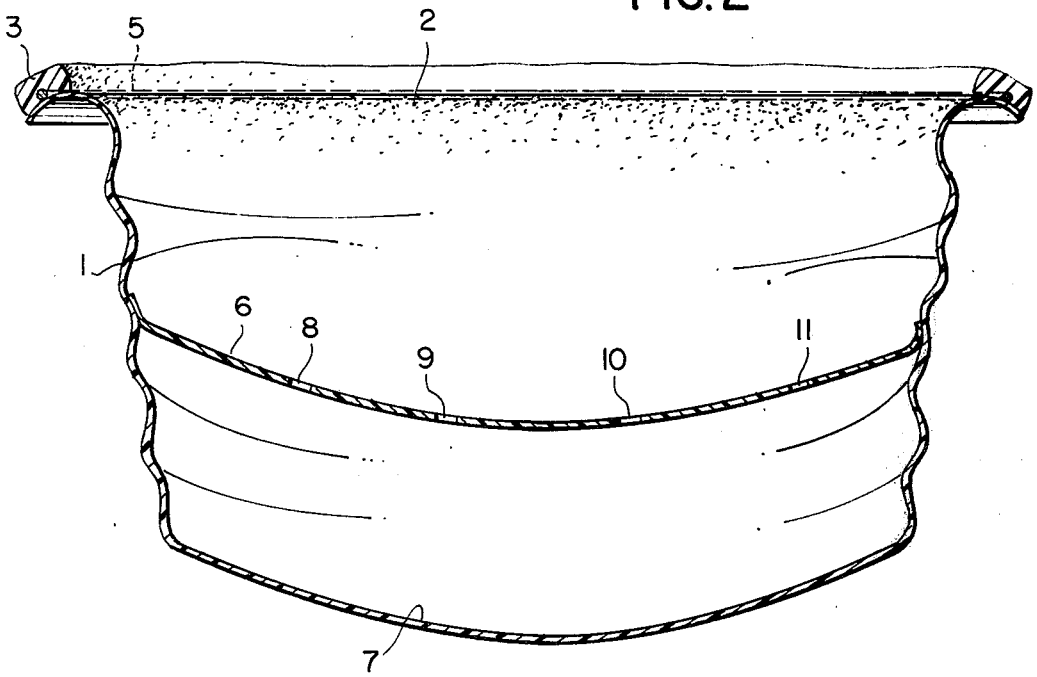
FIG. 3

DISPOSABLE BEDPAN DEVICE

DESCRIPTION OF THE INVENTION

The present invention relates to a disposable bedpan device.

Objects of the invention are to provide a disposable bedpan device of simple structure, which is inexpensive in manufacture, and functions efficiently, effectively and reliably to relieve bedridden patients of severe pain experienced when he or she is lifted onto a conventional bedpan and to remove waste material from bedridden patients with minimum discomfort to patients by preventing leakage therefrom of materials and odors. A patient thus experiences minimum discomfort due to the elimination or considerable reduction of pain caused by movement and the prevention of leakage of materials and odors.

In order that the invention may be readily carried into effect, it will now be described with reference to the accompanying drawing, wherein:

FIG. 1 is a view of a patient in a prone position utilizing the disposable bedpan device of the invention;

FIG. 2 is a view of a patient in a reclining position utilizing the disposable bedpan device of the invention; and FIG. 3 is a sectional view of an embodiment of the disposable bedpan device of the invention.

In the FIGS., the same components are identified by the same reference numerals.

The disposable bedpan device of the invention comprises a bag 1 of waterproof soft-textured material such as, for example, plastic, having an open mouth 2 (FIG. 3). The plastic material of the bag 1 is preferably transparent to permit medical examination of the contents of the bag.

A collar 3 (FIG. 3) of soft foam material such as, for example, plastic foam, is provided around the mouth 2 of the bag 1. The foam material 3 is adherent to the skin of the user 4 (FIGS. 1 and 2) to insure a snug fit when in use and to prevent leakage of the contents of the bag, thereby preventing discomfort of the patient, who is usually a patient who is not permitted to, or not able to, move from a prone or reclining position.

A substantially flexible wire 5 (FIG. 3) is embedded in the collar 3 and extends around the mouth 2 for adjusting the opening of the mouth of the bag.

A sheet 6 of substantially flexible material is provided in the bag 1 extending substantially parallel to the bottom 7 of the bag and intermediate the bottom and the mouth of the bag. The sheet 6 has openings 8, 9, 10, 11, and so on, formed therethrough whereby the sheet obstructs solid matter and permits liquids to pass to the bottom of the bag thereby further insuring that liquids will not leak out of the bag.

While the invention has been described by means of a specific example and in a specific embodiment, we do not wish to be limited thereto, for obvious modifications will occur to those skilled in the art without departing from the spirit and scope of the invention.

We claim:

1. A disposable bedpan device, comprising a bag made of waterproof soft-textured material having an open mouth and a bottom;

a collar of soft foam material around the mouth of the bag, said foam material being adherent to the skin of a user to insure a snug fit when in use;

substantially flexible wire embedded in the collar and extending around the mouth for adjusting the opening of the mouth of the bag; and a sheet of substantially flexible material in the bag and extending substantially parallel to the bottom and intermediate the bottom and the mouth of the bag, said sheet having openings formed therethrough whereby said sheet obstructs solid matter and permits liquids to pass to the bottom of the bag.

* * * * *